US010881225B1

(12) United States Patent
Bernick

(10) Patent No.: US 10,881,225 B1
(45) Date of Patent: Jan. 5, 2021

(54) COVER FOR A DUVET AND METHOD OF USE

(71) Applicant: DeBora Rachelle Maki Bernick, Duluth, MN (US)

(72) Inventor: DeBora Rachelle Maki Bernick, Duluth, MN (US)

( * ) Notice: Subject to any disclaimer, the term of this patent is extended or adjusted under 35 U.S.C. 154(b) by 306 days.

(21) Appl. No.: 16/034,478

(22) Filed: Jul. 13, 2018

(51) Int. Cl.
*A47G 9/02* (2006.01)
*A47G 9/04* (2006.01)

(52) U.S. Cl.
CPC ..... *A47G 9/0261* (2013.01); *A47G 9/0207* (2013.01); *A47G 9/04* (2013.01)

(58) Field of Classification Search
CPC ..... A47C 21/022; A47G 9/0261; A47G 9/04; A47G 9/0207; A47G 9/0223; A47G 2009/0269
See application file for complete search history.

(56) References Cited

U.S. PATENT DOCUMENTS 7,181,790 B2 * 2/2007 Wirtz ..... A47G 9/0261 5/501

FOREIGN PATENT DOCUMENTS

| | | | | |
|---|---|---|---|---|
| FR | 2838037 A1 * | 10/2003 | ..... | A47G 9/0261 |
| GB | 2452265 A * | 3/2009 | ..... | A47C 21/022 |
| GB | 2562763 A * | 11/2018 | ..... | A47G 9/04 |

* cited by examiner

*Primary Examiner* — Eric J Kurilla
*Assistant Examiner* — James T Coble
(74) *Attorney, Agent, or Firm* — Ted Masters

(57) ABSTRACT

A cover for a duvet includes a sheet of fabric which has a first section and a second section. The first section has a left side, a right side, and a transverse side. The second section has a left side, a right side, and a transverse side. A left closure is configured to only connect the left side of the first section to the left side of the second section, and a right closure is configured to only connect the right side of the first section to the right side of the second section. A hood is connected to either the transverse side of the first section or the transverse side of the second section. After the left and rights sides of the two sections are connected, the hood is folded over to completely enclose the duvet.

20 Claims, 8 Drawing Sheets

FIG. 3
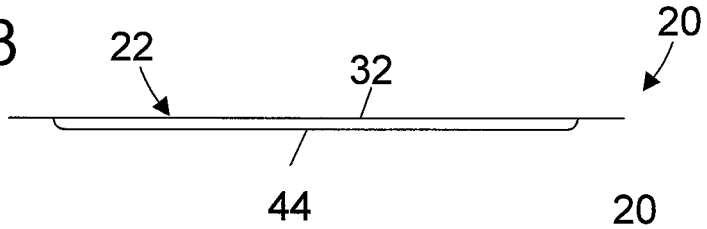
FIG. 1
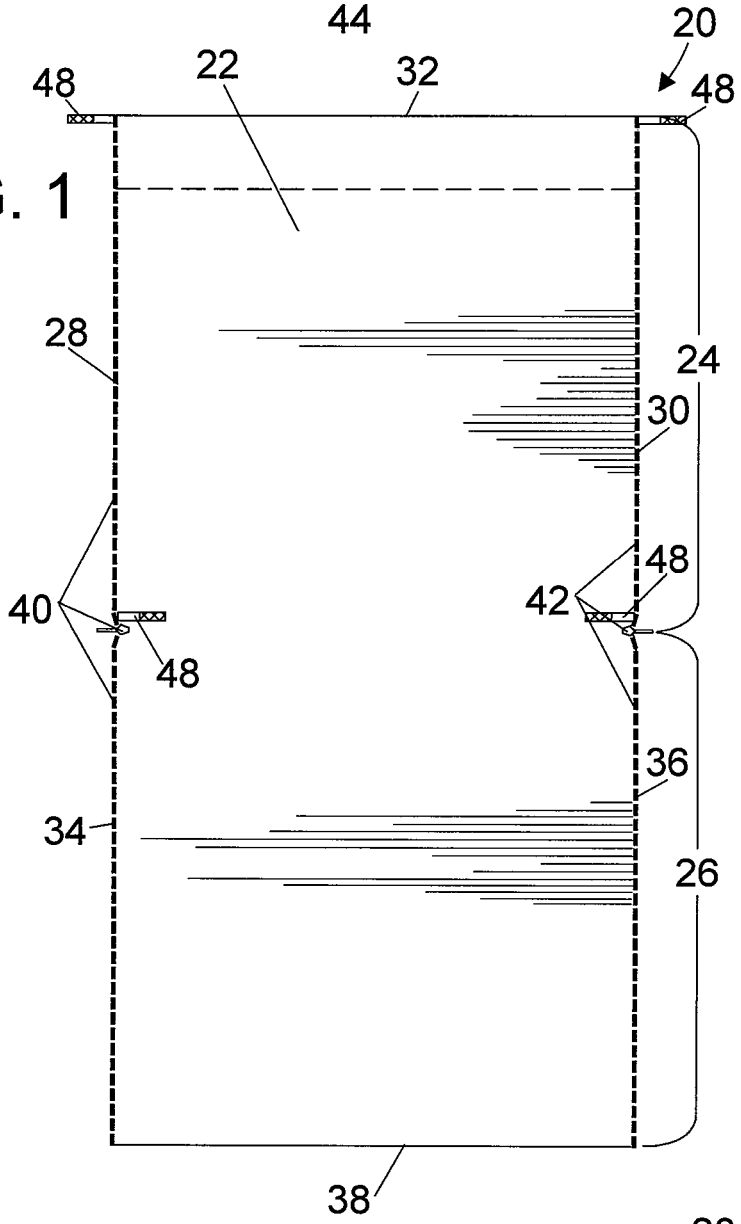
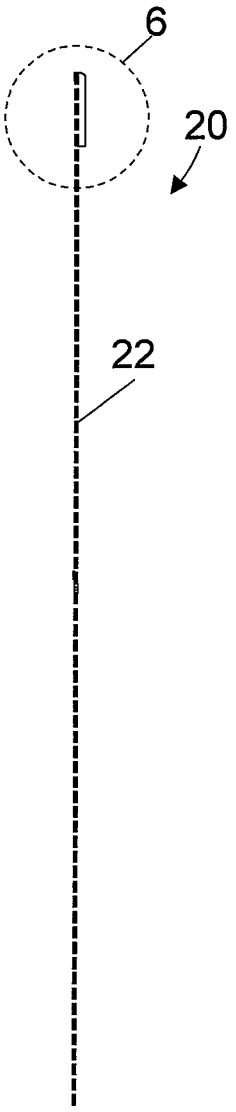
FIG. 2
FIG. 4
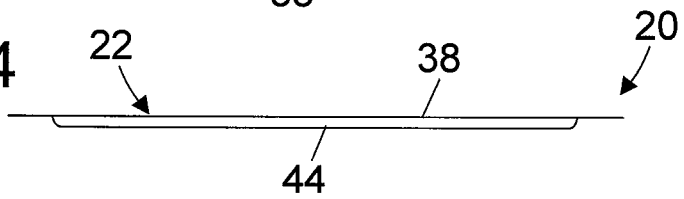

FIG. 8
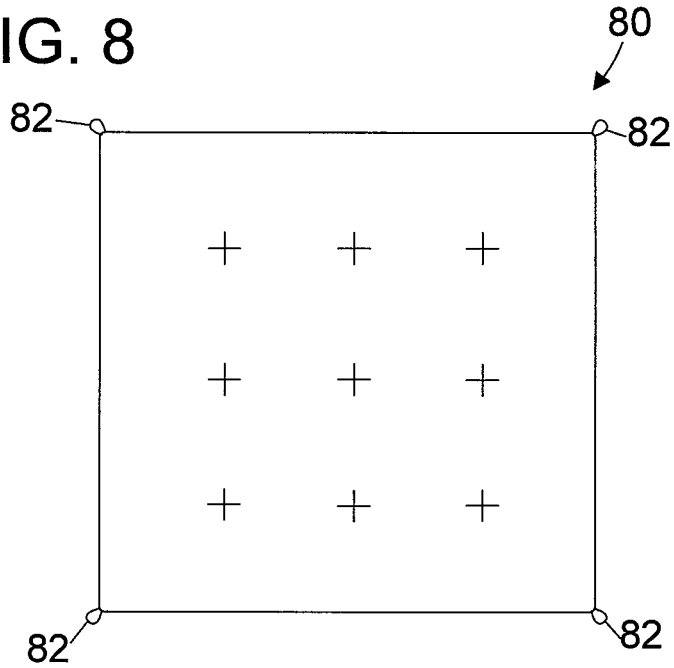
FIG. 9
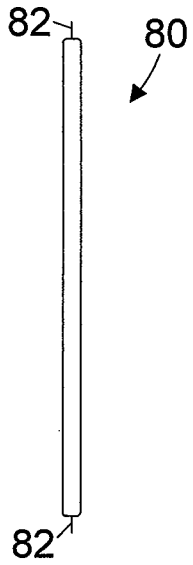
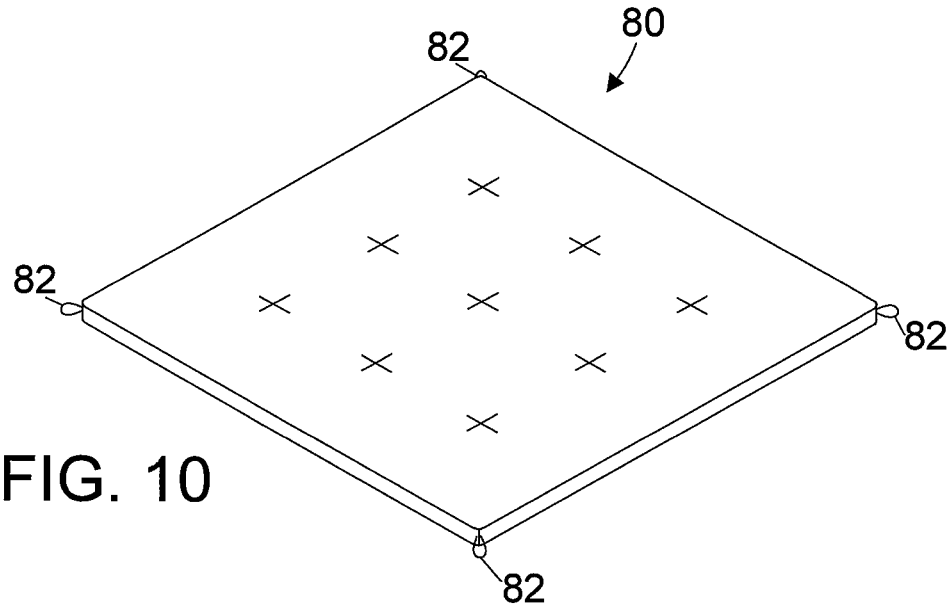
FIG. 10

FIG. 13
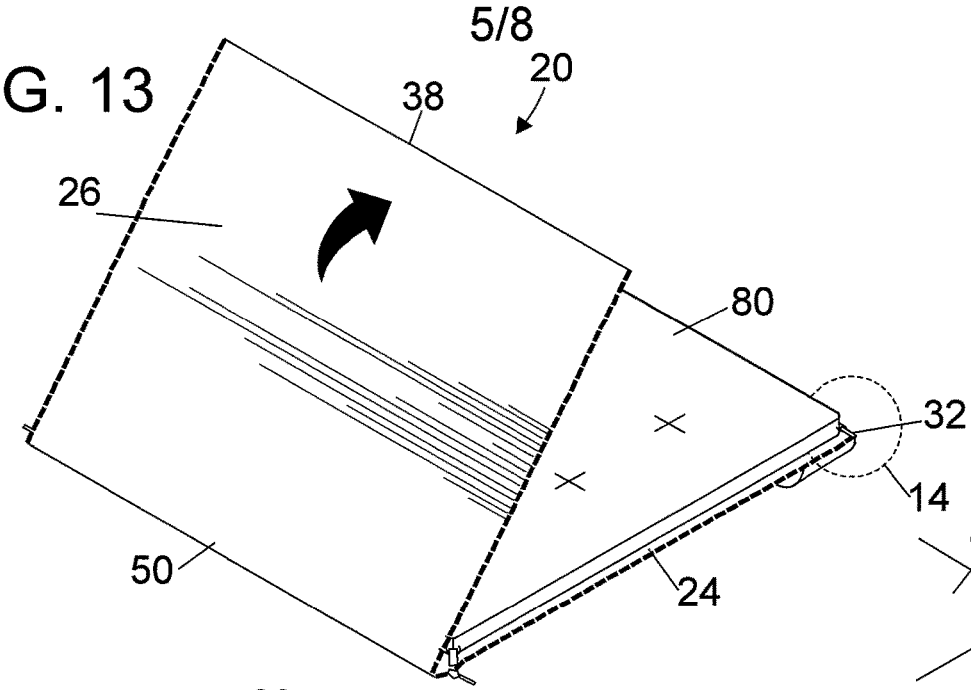
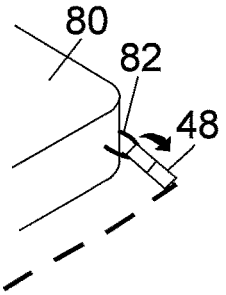
FIG. 14
FIG. 15
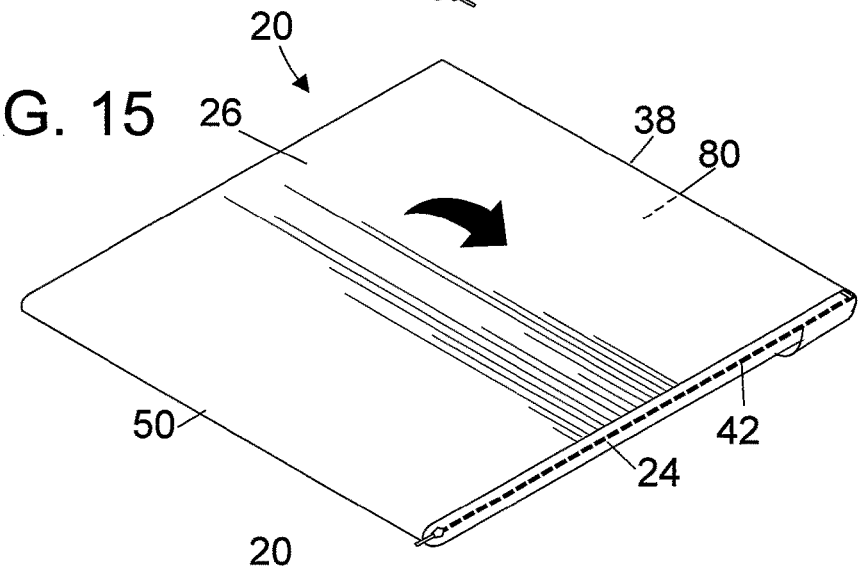
FIG. 16
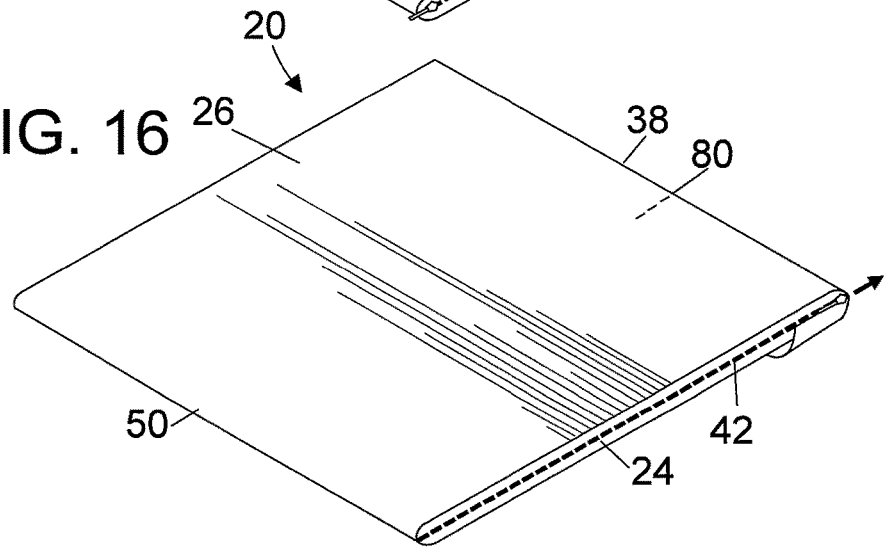

FIG. 24
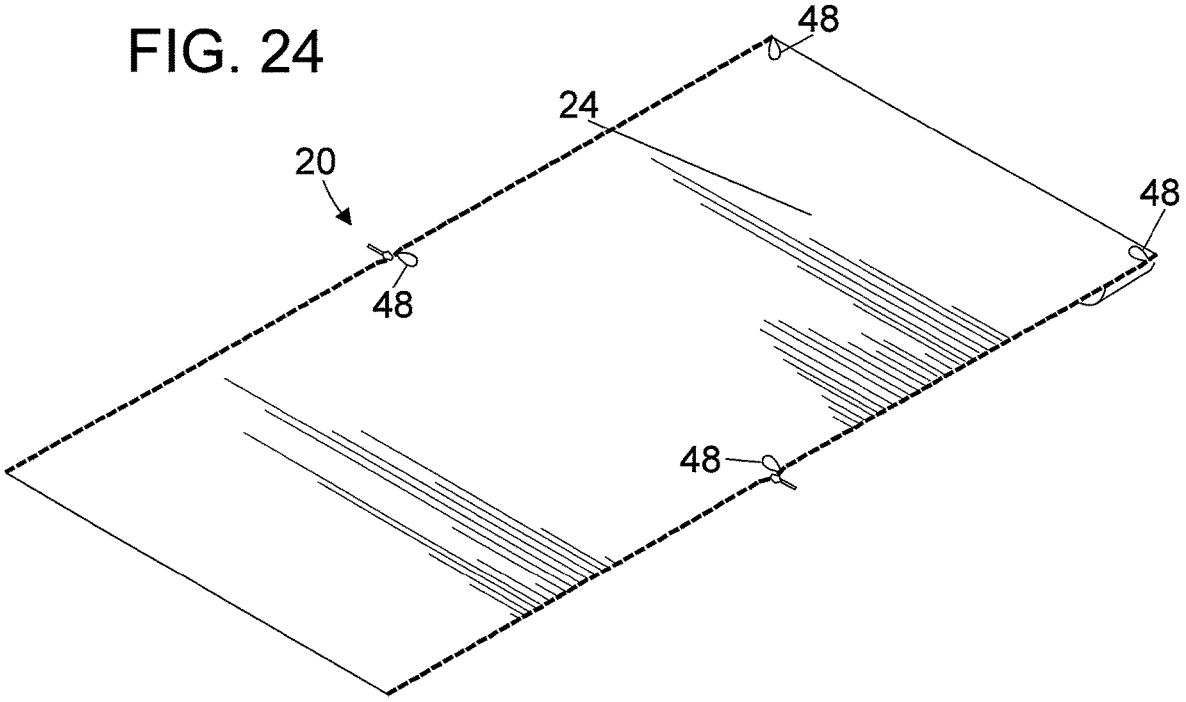
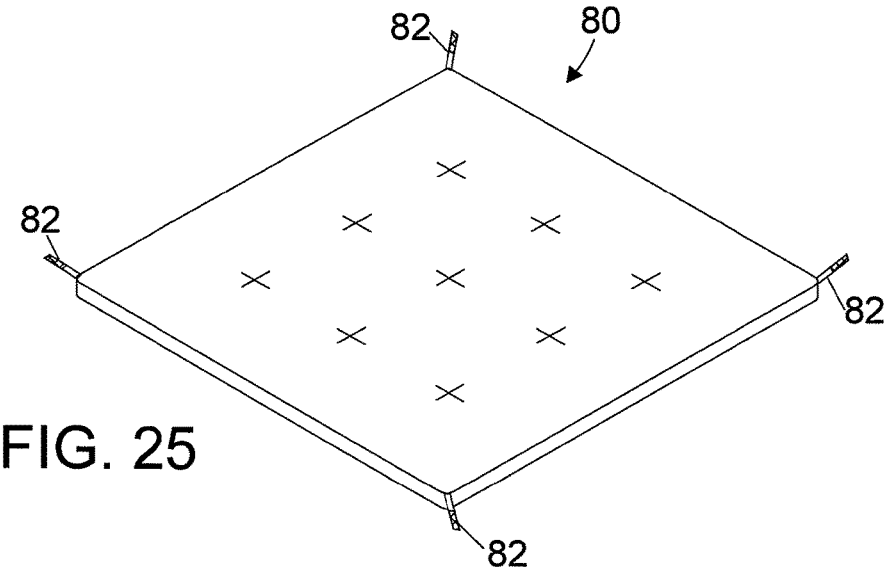
FIG. 25

COVER FOR A DUVET AND METHOD OF USE

CROSS REFERENCE TO RELATED APPLICATION

None

TECHNICAL FIELD

The present invention pertains generally to bedclothes, and more particularly to a cover for a duvet.

BACKGROUND OF THE INVENTION

Duvets are a well known form of bedclothes which typically require a cover to prevent soiling. Inserting the duvet evenly into the cover can present problems. Prior art devices address this problem by utilizing zippers which are disposed on three sides of the cover. However, these zippers must go around the corners of the cover and in so doing can have a tendency to malfunction.

BRIEF SUMMARY OF THE INVENTION

The present invention is directed to a cover for a duvet which has closures on two opposite sides. Another side comprises a fold, and the fourth side remains unconnected but can be covered with a hood. The cover is simply spread out upon a horizontal surface such as a bed, and the duvet positioned upon one half of the cover. The other half is then folded over the top of the duvet, and two opposite sides are closed. A hood is connected to one of the halves. Once the closures are engaged, the hood is folded over the open side of the cover to completely enclosure the duvet within the cover. The cover is quick and easy to install around the duvet using a bed as a work platform.

In accordance an embodiment, a cover for a duvet includes a sheet of fabric which has a first section and a second section. The first section has a left side, a right side, and a transverse side, and the second section has a left side, a right side, and a transverse side. A left closure is configured to only connect the left side of the first section to the left side of the second section; and a right closure is configured to only connect the right side of the first section to the right side of the second section.

In accordance with another embodiment, the first section and the second section are positionable to a folded configuration in which the duvet is disposed between the first section and the second section. In the folded configuration, the transverse side of the first section is not connected to the transverse side of the second section.

In accordance with another embodiment, the left closure and the right closure are each slide fasteners.

In accordance with another embodiment, a hood is connected to one of the transverse side of the first section and the transverse side of the second section. In the folded configuration the hood is configured to fold over the other of the transverse side of the first section and the transverse side of the second section.

In accordance with another embodiment, the cover has a ready-for-use configuration in which the duvet is enclosed within the cover, the ready-for-use configuration including (1) the left closure connecting the left side of the first section to the left side of the second section, (2) the right closure connecting the right side of the first section to the right side of the second section, (3) the first section and the second section defining a fold therebetween, (4) an opening between the transverse side of the first section and the transverse side of the second section, and (5) the hood covering the opening between the transverse side of the first section and the transverse side of the second section.

In accordance with another embodiment, the duvet has four corner connectors. The first section has four connectors which are configured to engage the four corner connectors of the duvet.

In accordance with another embodiment, the four corner connectors of the duvet are each straps, and the four connectors are each loops which are configured to engage the four straps.

In accordance with another embodiment, in the folded configuration the first section and the second section define a fold therebetween. At least one sheet strap is connected at the fold.

Other embodiments, in addition to the embodiments enumerated above, will become apparent from the following detailed description, taken in conjunction with the accompanying drawings, which illustrate, by way of example, the principles of the cover for a duvet and method of use.

BRIEF DESCRIPTION OF THE DRAWINGS

FIG. 1 is a top plan view of a cover for a duvet;

FIG. 2 is a side elevation view of the cover;

FIG. 3 is an end elevation view of the cover;

FIG. 4 is an opposite end elevation view of the cover;

FIG. 8 is a top plan view of a duvet;

FIG. 9 is a side elevation view of the duvet;

FIG. 10 is a top perspective view of the duvet;

FIG. 13 is a top perspective view of the cover being placed in a folded configuration;

FIG. 14 is an enlarged perspective view of area 14 of FIG. 13;

FIG. 15 is a perspective view of the cover in the folded configuration;

FIG. 16 is a top perspective view of the cover in the folded configuration with left and right sides connected;

FIG. 24 is a top perspective view of another embodiment of the cover; and,

FIG. 25 is a top perspective view of another embodiment of the duvet.

DETAILED DESCRIPTION OF THE INVENTION

Figure 5:
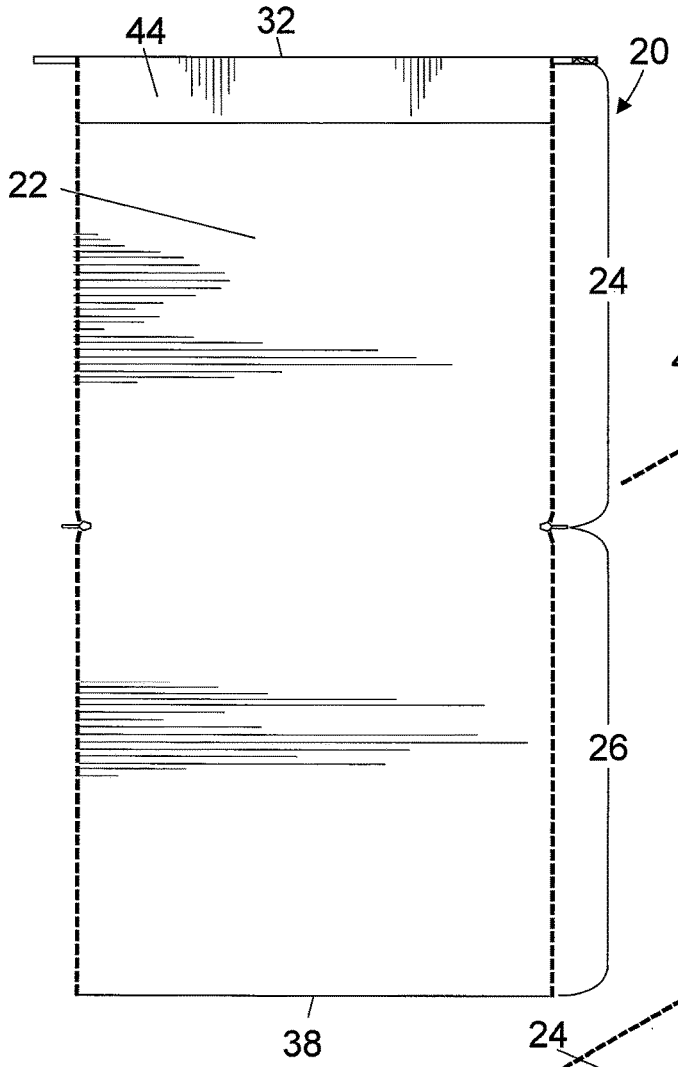
FIG. 5 is a bottom plan view of the cover.

Referring initially to FIGS. 1-7, there is illustrated a cover for a duvet, generally designated as 20. Cover 20 includes a sheet of fabric 22 which has a first section 24 and an adjoining second section 26 (top and bottom respectively as shown). In the shown embodiment sheet of fabric 22 is rectangular and of a size which is sufficient to cover a duvet 80 (refer to FIGS. 8-10). Sheet of fabric 22 is preferably a single sheet of fabric material, but could also be made from multiple pieces of fabric which are permanently sewn together. First section 24 has a left side 28, an opposite and parallel right side 30, and a transverse side 32 which is perpendicular to left side 28 and right side 30. Second section 26 has a left side 34, an opposite and parallel right side 36, and a transverse side 38 which is perpendicular to left side 34 and right side 36. In FIG. 1 sheet of fabric 22 is shown in a flat spread out horizontal position.

Also referring to FIGS. 13 and 15, first section 24 and second section 26 are positionable to a folded configuration in which duvet 80 is disposed between first section 24 and second section 26. From the folded configuration, a left closure 40 and an opposite right closure 42 are utilized to removably connect first section 24 to second section 26 with duvet 80 housed therebetween (refer to FIGS. 16-19). The left closure 40 is configured to only connect left side 28 of first section 24 to left side 34 of second section. Similarly the opposite right closure 42 is configured to only connect right side 30 of first 24 to said right side 36 of second section 26. In the shown embodiment left 40 and right 42 closures are slide fasteners (such as zippers) which are herein shown in bold broken lines. However, it may be appreciated that closures 40 and 42 could be hook and loop fasteners, buttons, snaps, or any other device which can removably connect the sides of the two sections together. In the shown slide fastener embodiment, left closure 40 and right closure 42 both include teeth disposed on both first section 24 and second section 26. It is further noted transverse sides 32 and 38 do not include a closure which connects the sides together.

Figure 6:
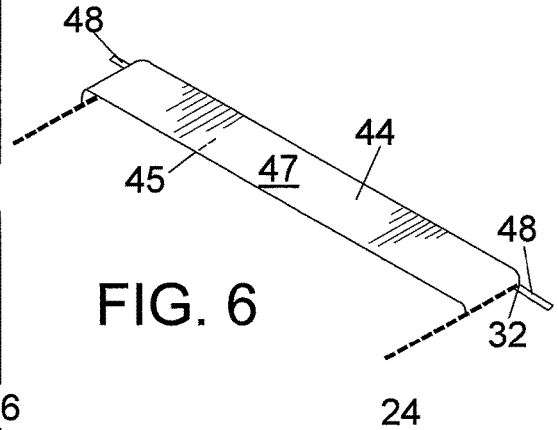
FIG. 6 is a perspective view of area 6 of FIG. 2.

A hood 44 is connected to one of the transverse side 32 of first section 24 and the transverse side 38 of second section 26. Also referring to FIGS. 21-22, in the folded configuration, and with left 40 and right 42 closures engaged, hood 44 is configured to fold over the other of transverse side 32 of first section 24 and transverse side 38 of second section 26. In the shown embodiment hood 44 is connected to transverse side 32 of first section 24, but it could alternatively be connected to transverse side 38 of second section 26. FIG. 6 is an enlarged perspective view of area 6 of FIG. 2 which shows hood 44. Hood 44 is a pocket which is connected to the back side of first section 24 at transverse side 32 and along part of first side 28 and second side 30. Hood 44 has an inside surface 45 and an opposite outside surface 47. As is disclosed below in the discussion of FIGS. 21 and 22, in the folded over configuration (FIG. 22) hood 44 is reversed (the inside surface becomes the outside surface) and folded over the transverse side 38 of second section 26.

Figure 7:
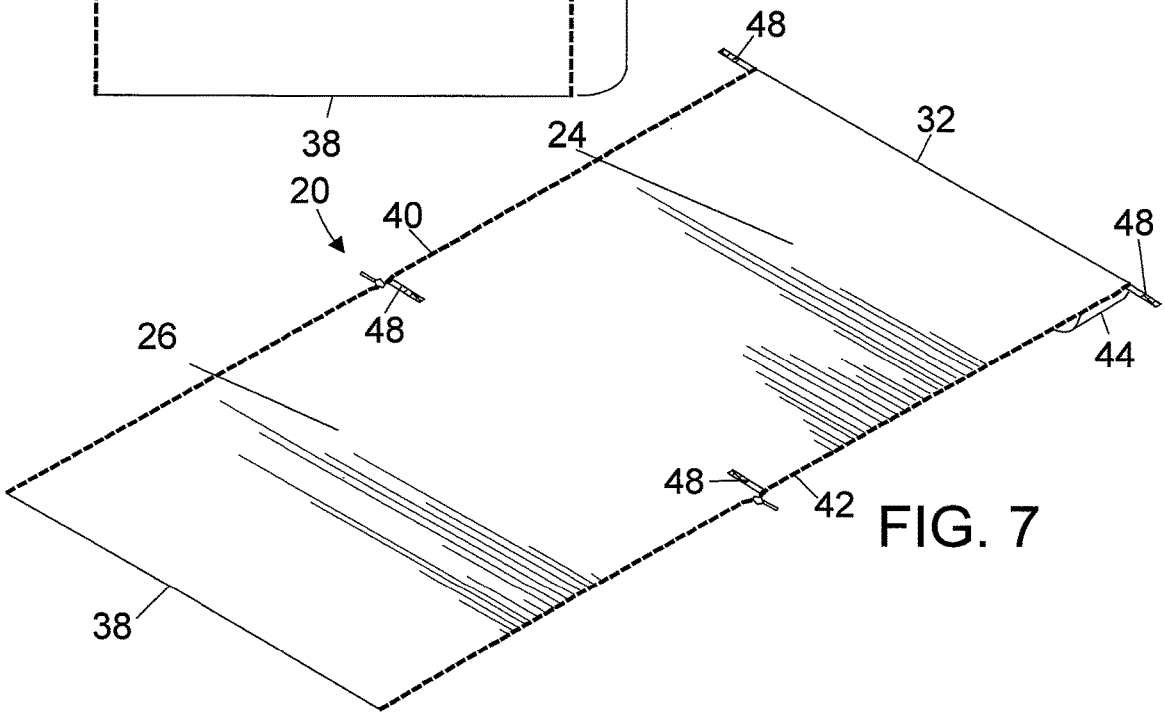
FIG. 7 is a top perspective view of the cover.

FIGS. 8-10 show duvet 80. Duvet 80 has four corner connectors 82. In the shown embodiment the four corner connectors 82 are each loops which are connected to the four corners 82 of duvet 80. Referring to FIGS. 1 and 7, first section 24 has four connectors 48 which are configured to engage the four corner connectors 82 of duvet 80. In the shown embodiment, four connectors 48 are each straps which engage the four loops of the duvet (also refer to FIGS. 11 and 12).

Figure 11:
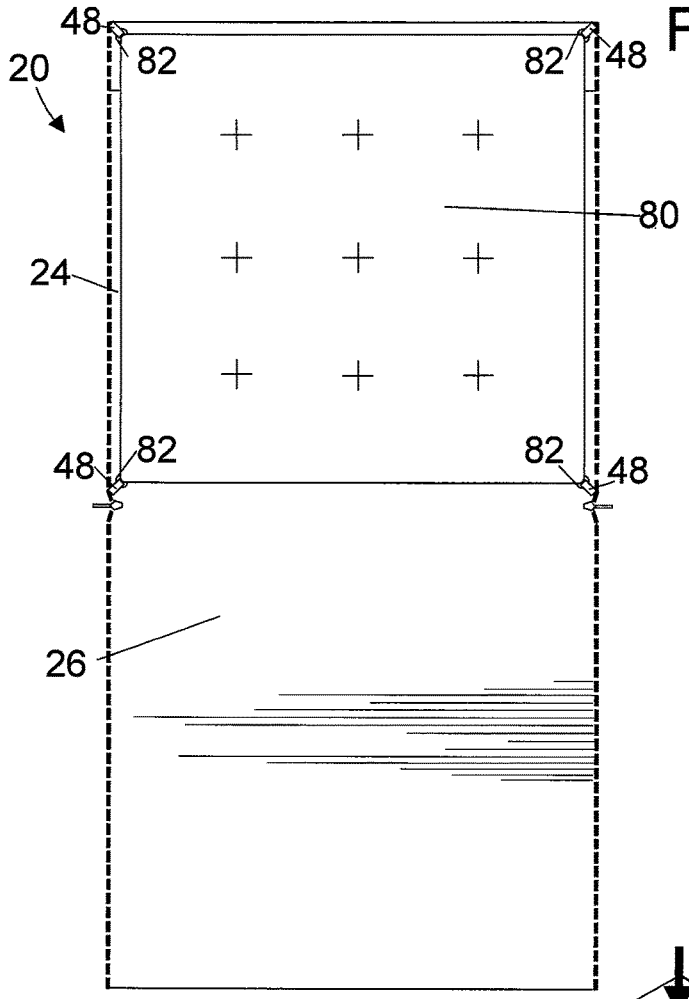
FIG. 11 is a top plan view of the duvet placed on and connected to the cover.
Figure 12:
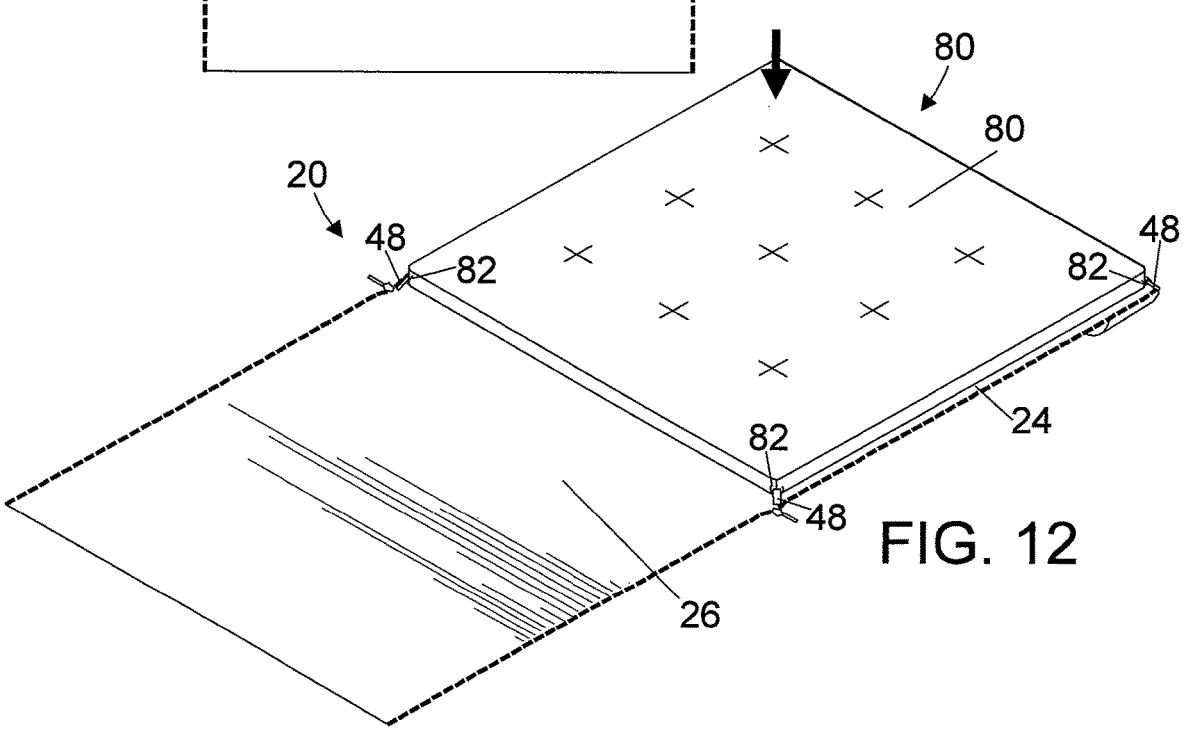
FIG. 12 is a top perspective view of the duvet placed on and connected to the cover.

FIGS. 11 and 12 show duvet 80 placed on and connected to cover 20. With cover 20 in the shown open flat position, duvet 80 is simply placed upon first section 24. The four connectors 48 of first section 24 are then used to engage the four corner connectors 82 of duvet 80. The connection serves to hold duvet 80 in place within cover 20. In the shown embodiment the four corner connectors 82 of duvet 80 are loops which are engaged by straps of first section 24. The straps include hook and loop fasteners so that they can be passed though the loops on duvet 80 and then folded over and connected back to themselves. It is also possible to reverse the connection, and place the loops on first section 24 of cover 20 and straps on duvet 80 (refer to FIGS. 24 and 25). It may be appreciated however that other methods of connection could also be utilized such as clips, clamps, ties, cords, string, belts, hook and loop fasteners, etc.

FIG. 13 is a top perspective view of cover 20 being placed in a folded configuration in which second section 26 is folded over to cover duvet 80. From the position of FIG. 12, in FIG. 13 second section 26 is folded over duvet 80.

FIG. 14 is an enlarged perspective view of area 14 of FIG. 13. Strap (connector 48) is passed through loop (corner connector 82) of duvet 80 and connected back to itself.

FIG. 15 is a perspective view of cover 20 in the folded configuration. Second section 26 has been fully folded over on top of duvet 80, but the left and right sides have not yet been connected.

After being placed in the folded configuration of FIG. 15, first closure 40 and second closure 42 are engaged. Also referring to FIGS. 1-7, FIGS. 16 and 17 are top perspective and side elevation views respectively of cover 20 in the folded configuration of FIG. 15 and with the left and right sides connected. Left side 28 of first section 24 is connected to the left side 34 of second section 26 using left closure 40 (refer to FIG. 18), and the right side 30 of first section 24 is connected to the right side of second section 26 using right closure 42, with duvet 80 disposed between the two sections. In FIG. 16 the folding is complete with transverse side 38 of second section 26 adjacent to transverse side 32 of first section 24. Also referring to FIG. 1, first closure 40 is then used to connect the first side 28 of first section 24 to the first side 34 of second section 26, and second closure 42 is used to connect the second side 30 of first section 24 to the second side 36 of second section 26 (refer also to the left perspective view of FIG. 18). In the shown embodiment, the closures are zippers which are used to connect the sides together, by pulling the zipper pull in the direction of the arrow in FIG. 16. It is noted that transverse side 32 of first section 24 is not connected to transverse side 38 of second section 26. That is, the transverse sides remain open so that the duvet 80 is only closed in by the left and right sides and the fold 50 between the first 24 and second 26 sections. Cover 20 is shaped and dimensioned to fully cover duvet 80 without squeezing or distorting the duvet 80. Different size covers 20 can be fabricated for use with different size duvets (e.g a twin size bed, a king size bed, a queen size bed, etc).

Figure 18:
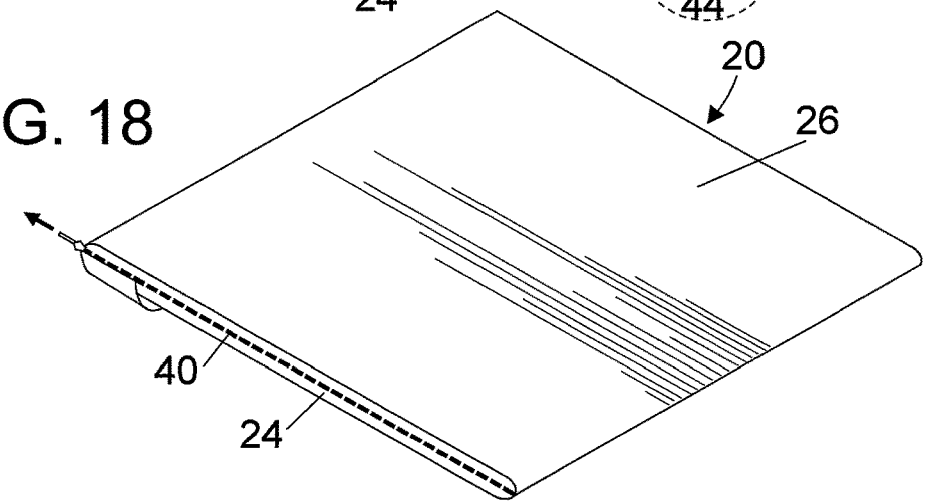
FIG. 18 is a left side perspective view of the cover in the folded configuration with the left and right sides connected.

FIG. 18 is a left side perspective view of cover 20 in the folded configuration with the left and right sides connected. Shown are cover 20, first section 24, second section 26, and left closure 40.

Figure 19:
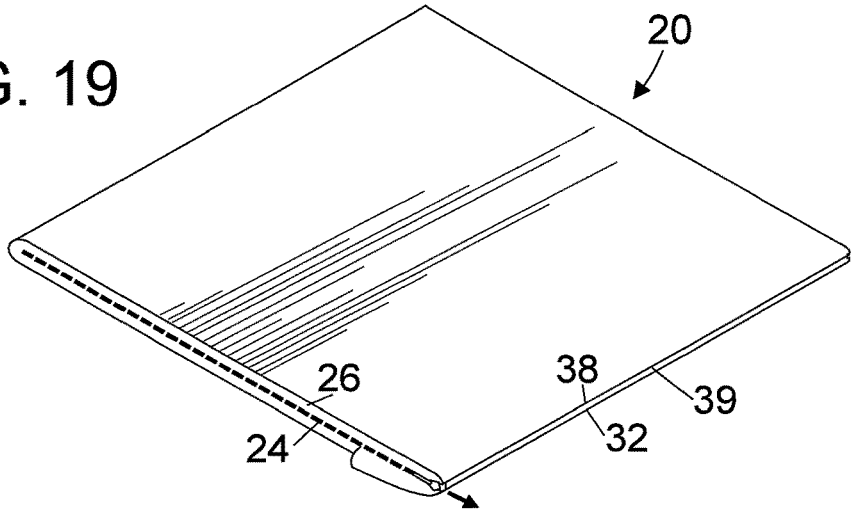
FIG. 19 is an opposite end perspective view of the cover in the folded configuration with the left and right sides connected.

FIG. 19 is an opposite end perspective view of cover 20 in the folded configuration with the left and right sides connected. It is noted that transverse side 32 of first section 24 is not connected to transverse side 38 of second section 26 and there is an opening 39 between the transverse sides. In other words, one side of cover 20 always remains open, even during use.

Figure 20:
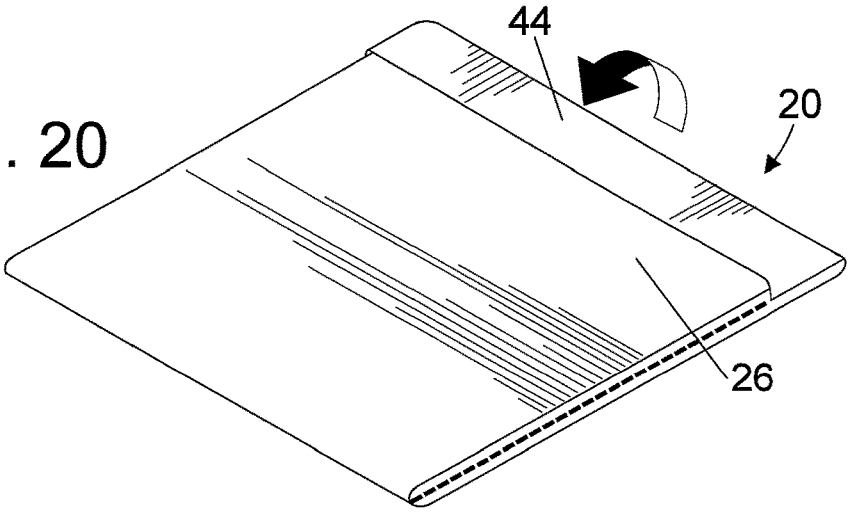
FIG. 20 is a top perspective view of the cover in a ready-for-use configuration with the hood moved to cover the opening at the transverse sides of the cover.

FIG. 20 is a top perspective view of cover 20 in a ready-for-use configuration with hood 44 moved to cover the opening 39 at transverse sides 32 and 38 (refer also to FIG. 19). In the ready-for-use configuration, duvet 80 is enclosed within cover 20. The ready-for-use configuration also includes (1) left closure 40 connecting left side 28 of first section 24 to left side 34 of second section 26, (2) right closure 42 connecting right side 30 of said section 24 to right side 36 of second section 26, (3) first section 24 and second section 26 defining a fold 50 therebetween, (4) an opening 39 between transverse side 32 of first section 24 and transverse side 38 of second section 26, and (5) hood 44 covering opening 39 between transverse side 32 of first section 24 and transverse side 38 of second section 26. (also refer to FIGS. 1-7, 8-10, 13-19, and 21-22).

Figure 17:
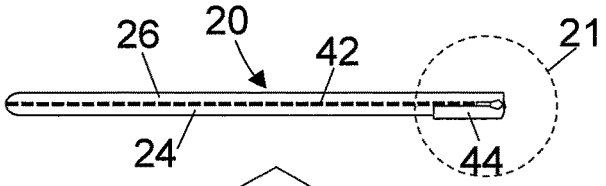
FIG. 17 is a side elevation view of the cover in the folded configuration with the the left and right sides connected.
Figure 21:
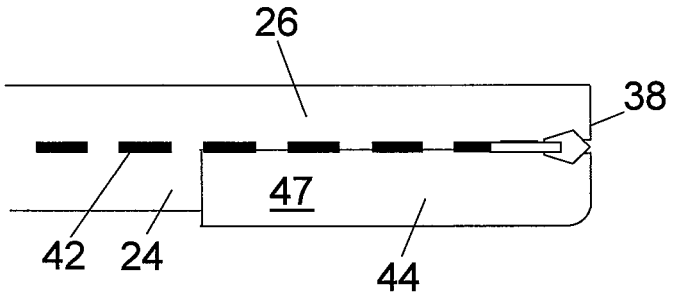
FIG. 21 is an enlarged view of area 21 of FIG. 17.
Figure 22:
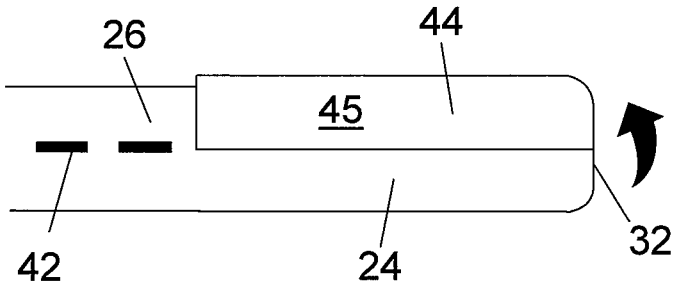
FIG. 22 is an enlarged view as in FIG. 21 with a hood moved to a cover the opening at the transverse sides.

FIG. 21 is an enlarged view of area 21 of FIG. 17, and FIG. 22 is an enlarged view as in FIG. 20 with hood 44 moved to cover the opening at transverse sides 32 and 38. As was previously discussed, in the folded configuration of cover 20 transverse sides 32 and 38 remain unconnected, and in the ready-for-use configuration sides 32 and 38 remain unconnected as well. Hood 44 serves the purpose of covering the opening at transverse sides 32 and 38. To that end, after cover 20 is placed in the folded configuration, and after the left and right side closures are engaged, hood 44 is disposed adjacent first section 24 as is shown in FIGS. 17 and 21. In FIG. 22 hood 44 which is connected to transverse side 32 of first side 24 is folded (flipped) over to cover transverse side 38 of second section 26, thus covering the open transverse sides (opening 39). It is noted that in the process of folding over hood 44, the inside surface 45 and outside surface 47 are reversed. Hood 44 serves to cover transverse side 32 and 38 so that duvet 80 (refer to FIGS. 8-10) is not visible, and also to protect the user from possible contact with closures 40 and 42 (refer also to FIG. 18). Referring also to FIGS. 1-4, in FIGS. 20-22 it is noted that hood 44 extends along the entire transverse width of transverse side 32 of first section 24. That is, hood 44 extends from left side 28 of first section to right side 30 of first section 24. As was previously pointed out, hood 44 could also be connected to transverse side 38 of second section 26. Also, in FIGS. 20-22 it is observed that when hood 44 is folded over transverse side 38 of second section 26, it folds over the entire transverse width of transverse side 38 of second section 26.

Figure 23:
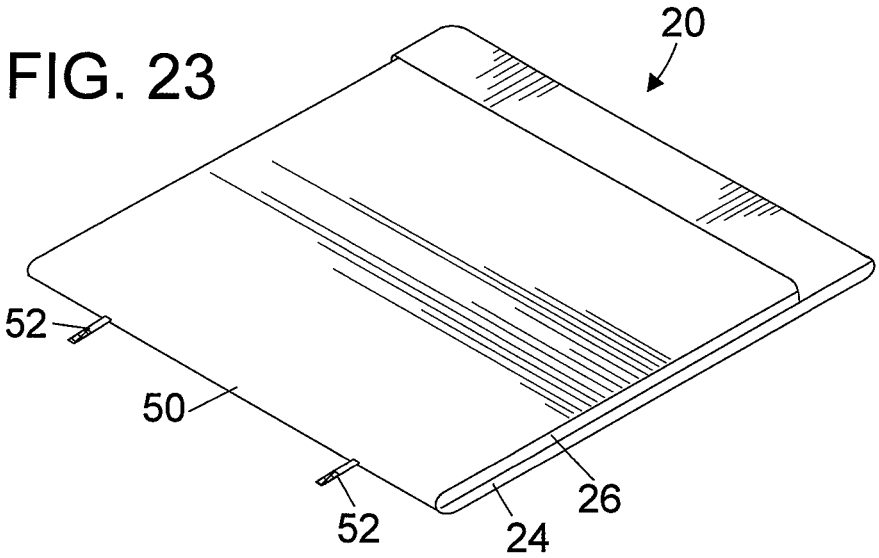
FIG. 23 is a top perspective view of the cover in the ready-for-use configuration showing other embodiments.

FIG. 23 is a top perspective view of cover 20 in the ready-for-use configuration showing other embodiments. It is first noted that left and right closures 40 and 42 (refer to FIG. 1) are hidden from view (such as with a narrow fabric flap). In the shown folded configuration, a fold 50 exists between first section 24 and second section 26. At least one (two in the shown embodiment) sheet strap 52 is connected at fold 50. Sheet strap 52 is the same as previously discussed straps, in that it folds back and connects to itself. Sheet strap 52 is configured to engage a loop which is disposed on the bottom sheet of a bed (not shown). As such, cover 20 and the enclosed duvet can be firmly connected to a fitted sheet to prevent unwanted movement.

FIG. 24 is a top perspective view of another embodiment of cover 20, and FIG. 25 is a top perspective view of another embodiment of duvet 80. In this embodiment four connectors 48 of first section 24 are loops, and four corner connectors 82 of duvet 80 are straps.

It may be appreciated that cover 20 can be combined with duvet 80 to form a bedclothes system.

In terms of use, a method of using bedclothes includes (refer to FIGS. 1-23):

(a) providing a duvet 80;

(b) providing a cover 20 for the duvet 80, including;

a sheet of fabric 22 which has a first section 24 and a second section 26;

the first section 24 having a left side 28, a right side 30, and a transverse side 30;

the second section 26 having a left side 34, a right side 36, and a transverse side 38;

a left closure 40 which is configured to only removably connect the left side 28 of the first section 24 to the left side 34 of the second section 26; and, a right closure 42 which is configured to only removably connect the right side 30 of the first section 24 to the right side 36 of the second section 26;

(c) placing the cover 20 in a horizontal position;

(d) placing the duvet 80 upon the first section 24 of the cover 20;

(e) folding the second section 26 over the duvet 80; and, (f) using the left closure 40 to connect the left side 28 of the first section 24 to the left side 34 of the second section 26, and using the right closure 42 to connect the right side 30 of the first section 24 to the right 36 of the second section 26.

The method further including:

after (f), the transverse side 32 of the first section 24 not connected to the transverse side 38 of the second section 26.

The method further including:

in (b), a hood 44 is connected to one of the transverse side 32 the first section 24 and the transverse side 38 of the second section 26; and, in (b), the hood 44 is configured to fold over the other of the transverse side 32 of the first section 24 and the transverse side 38 of the second section 26; and, after (f), folding the hood 44 over the other of the transverse side 32 of the first section 24 and the transverse side 38 of the second section 26.

The method further including:

in (a), the duvet 80 having four corner connectors 82;

in (b), the first section 24 having four connectors 48 which are configured to engage the four corner connectors 82 of the duvet 80; and, in (d), connecting the four connectors 48 to the four corner connectors 82 of the duvet 80.

unless specifically otherwise stated, and as applicable, the order of performance of the above cited method steps can be changed.

The embodiments of the cover for a duvet and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the cover and method should be construed as limiting the invention to a particular embodiment or combination of embodiments. The scope of the invention is defined by the appended claims.

I claim:

1. A cover for a duvet, comprising:

a sheet of fabric having a first section and a second section;

said first section having a left side, a right side, and a transverse side;

said second section having a left side, a right side, and a transverse side;

a left closure which is configured to only connect said left side of said first section to said left side of said second section;

a right closure which is configured to only connect said right side of said first section to said right side of said second section;

said first section and said second section are positionable to a folded configuration in which the duvet is disposed between said first section and said second section;

a hood connected to one of said transverse side of said first section and said transverse side of said second section, said hood extending along an entire transverse width of one of said transverse side of said first section and said transverse side of said second section; and, in said folded configuration said hood is configured to fold over an entire transverse width of the other of said transverse side of said first section and said transverse side of said second section.

2. The cover for a duvet according to claim 1, further including:

said first section and said second section are positionable to a folded configuration in which the duvet is disposed between said first section and said second section; and, in said folded configuration, said transverse side of said first section is not connected to said transverse side of said second section.

3. The cover for a duvet according to claim 1, further including:

said left closure and said right closure each being a slide fastener.

4. The cover for a duvet according to claim 1, further including:

a ready-for-use configuration in which the duvet is enclosed within the cover, said ready-for-use configuration including (1) said left closure connecting said left side of said first section to said left side of said second section, (2) said right closure connecting said right side of said first section to said right side of said second section, (3) said first section and said second section defining a fold therebetween, (4) an opening between said transverse side of said first section and said transverse side of said second section, and (5) said hood covering said opening between said transverse side of said first section and said transverse side of said second section.

5. The cover for a duvet according to claim 1, the duvet having four corner connectors, the cover for a duvet further including:

said first section having four connectors which are configured to engage the four corner connectors of the duvet.

6. The cover for a duvet according to claim 5, the four corner connectors of the duvet each being straps, the cover for a duvet further including:

said four connectors each being loops which are configured to engage the four straps.

7. The cover for a duvet according to claim 1, further including:

said first section and said second section are positionable to a folded configuration in which the duvet is disposed between said first section and said second section;

in said folded configuration said first section and said second section define a fold therebetween; and, at least one sheet strap connected at said fold.

8. The cover for a duvet according to claim 1, the duvet having four corner connectors, the cover for a duvet further including:

said first section and said second section are positionable to a folded configuration in which the duvet is disposed between said first section and said second section;

in said folded configuration, said transverse side of said first section not connected to said transverse side of said second section;

a ready-for-use configuration in which the duvet is enclosed within the cover, said ready-for-use configuration including (1) said left closure connecting said left side of said first section to said left side of said second section, (2) said right closure connecting said right side of said first section to said right side of said second section, (3) said first section and said second section defining a fold therebetween, (4) an opening between said transverse side of said first section and said transverse side of said second section, and (5) said hood covering said opening between said transverse side of said first section and said transverse side of said second section: and, said first section having four connectors which are configured to engage the four corner connectors of the duvet.

9. A bedclothes system, comprising:

a duvet;

a cover which includes a sheet of fabric having a first section and a second section;

said first section having a left side, a right side, and a transverse side;

said second section having a left side, a right side, and a transverse side;

a left closure which is configured to only connect said left side of said first section to said left side of said second section;

a right closure which is configured to only connect said right side of said first section to said right side of said second section;

said first section and said second section are positionable to a folded configuration in which said duvet is disposed between said first section and said second section;

a hood connected to one of said transverse side of said first section and said transverse side of said second section, said hood extending along an entire transverse width of one of said transverse side of said first section and said transverse side of said second section; and, in said folded configuration said hood is configured to fold over an entire transverse width of the other of said transverse side of said first section and said transverse side of said second section.

10. The bedclothes system according to claim 9, further including:

said first section and said second section are positionable to a folded configuration in which said duvet is disposed between said first section and said second section; and, in said folded configuration, said transverse side of said first section is not connected to said transverse side of said second section.

11. The bedclothes system according to claim 9, further including:

said left closure and said right closure each being a slide fastener.

12. The bedclothes system according to claim 9, further including:

a ready-for-use configuration in which the duvet is enclosed within the cover, said ready-for-use configuration including (1) said left closure connecting said left side of said first section to said left side of said second section, (2) said right closure connecting said right side of said first section to said right side of said second section, (3) said first section and said second section defining a fold therebetween, (4) an opening between said transverse side of said first section and said transverse side of said second section, and (5) said hood covering said opening between said transverse side of said first section and said transverse side of said second section.

13. The bedclothes system according to claim 9, further including:

said duvet having four corner connectors; and, said first section having four connectors which are configured to engage said four corner connectors of said duvet.

14. The bedclothes system according to claim 13, further including:

said four corner connectors of said duvet each being straps; and, said four connectors each being loops which are configured to engage said four straps.

15. The bedclothes system according to claim 9, further including:

said first section and said second section are positionable to a folded configuration in which said duvet is disposed between said first section and said second section;

in said folded configuration said first section and said second section define a fold therebetween; and, at least one sheet strap connected at said fold.

16. A method of using bedclothes, comprising:

(a) providing a duvet;

(b) providing a cover for said duvet, including;

a sheet of fabric having a first section and a second section;

said first section having a left side, a right side, and a transverse side;

said second section having a left side, a right side, and a transverse side;

a left closure which is configured to only connect said left side of said first section to said left side of said second section;

a right closure which is configured to only connect said right side of said first section to said right side of said second section; and, a hood connected to one of said transverse side of said first section and said transverse side of said second section, said hood extending along an entire transverse width of one of said transverse side of said first section and said transverse side of said second section;

(c) placing said cover in a horizontal position;

(d) placing said duvet upon said first section of said cover;

(e) folding said second section over said duvet; and, (f) using said left closure to connect said left side of said first section to said left side of said second section, and using said right closure to connect said right side of said first section to said right side of said second section.

17. The method of claim 16, further including:

after (f), said transverse side of said first section not connected to said transverse side of said second section.

18. The method of claim 16, further including:

after (f), folding said hood over an entire transverse width of said other of said transverse side of said first section and said transverse side of said second section.

19. The method of claim 16, further including:

in (a), said duvet having four corner connectors;

in (b), said first section having four connectors which are configured to engage said four corner connectors of said duvet; and, in (d), connecting said four connectors to said four corner connectors of said duvet.

20. A cover for a duvet, comprising:

a sheet of fabric having a first section and a second section;

said first section having a left side, a right side, and a transverse side;

said second section having a left side, a right side, and a transverse side;

a left closure which is configured to only connect said left side of said first section to said left side of said second section;

a right closure which is configured to only connect said right side of said first section to said right side of said second section;

said first section and said second section are positionable to a folded configuration in which the duvet is disposed between said first section and said second section;

in said folded configuration said first section and said second section define a fold therebetween; and, at least one sheet strap connected at said fold.

* * * * *